United States Patent [19]

Bessho

[11] 4,375,781

[45] Mar. 8, 1983

[54] DOUBLE-ACTING HYDRAULIC PRESS

[76] Inventor: Michio Bessho, 644 Bessho, Besshocho, Himeji, Hyogo, Japan

[21] Appl. No.: 204,331

[22] Filed: Nov. 5, 1980

[30] Foreign Application Priority Data

Nov. 12, 1979 [JP] Japan ..... 54-146939

[51] Int. Cl.[3] ..... F01B 7/20

[52] U.S. Cl. ..... 92/52; 92/53; 92/65; 100/269 B; 425/451.2; 425/590

[58] Field of Search ..... 92/52, 65, 53; 100/269 B 425/451.2;590;DIG. 223;406

[56] References Cited

U.S. PATENT DOCUMENTS

| | | | |
|---|---|---|---|
| 2,173,358 | 9/1939 | Ernst | 92/52 |
| 2,646,504 | 7/1953 | Gosline | 92/52 |
| 2,649,693 | 8/1953 | Venus | 92/52 |
| 3,302,535 | 2/1967 | Procter | 92/52 |
| 3,464,263 | 9/1969 | Omandam, Sr. | 92/53 |
| 3,732,784 | 5/1973 | Vogelei | 92/65 |
| 3,791,262 | 2/1974 | Staehlin | 92/65 |
| 4,111,629 | 9/1978 | Nussbaumer | 425/451.2 |
| 4,125,059 | 11/1978 | Tuji | 92/65 |

*Primary Examiner*—Abraham Hershkovitz

*Attorney, Agent, or Firm*—Munson H. Lane; Munson H. Lane, Jr.

[57] ABSTRACT

In a double-acting hydraulic press: an outer press ram having a cylinder formed therewithin for the piston of an inner press ram, the inner and outer ram cylinders in communication with one another and the rams being subject to a common hydraulic actuating means, each ram carrying a separate and distinct tool at its forward face, and means controllably feeding pressurized hydraulic fluid to an intermediate section of said inner ram cylinder, whereby to control the effective hydraulic force applied to said inner ram and the tool thereof.

3 Claims, 2 Drawing Figures

DOUBLE-ACTING HYDRAULIC PRESS

BACKGROUND OF THE INVENTION

The present invention relates to a double-acting hydraulic press. It relates to a newly developed double-acting hydraulic press in which the distribution of the output of both the inner press ram and the outer press ram to the total output as a hydraulic press can freely be changed within the range of a fixed total output.

Needless to say, neither in conventional double-acting machine presses, nor in conventional double-acting hydraulic presses, are the output of the inner press ram and the output of the outer press ram independent of each other, nor can the maximum output be separately set for each of them, so it is impossible to use the output of one of them for the other.

By way of illustration, with a double-acting press in which the output of the inner press ram (hereinafter referred to as 'inner output') is 500 tons, and the output of the outer press ram (hereinafter referred to as 'outer output') is 1,100 tons, totalling 1,600 tons, a product which requires a punch resistance of 500 tons and mold compression power of 1,100 tons, by using the above press, can be made to resist against the punch resistance of the inner press ram and against the mold compression power of the outer press ram, thus naturally making possible press processing.

However, in case of a product which is provided with a punch resistance of 850 tons and a mold compressor power of 750 tons, press processing is impossible due to insufficient inner output, even though the total output required of the said press is the same. Further, to making processing possible, even by producing a double-acting press with a performance of 850 tons inner output and 750 tons outer output, in this instance processing becomes impossible due to insufficient mold compression power against a product with a punch resistance of 500 tons and a mold compression power of 1,100 tons.

In order to make processing of the above two products possible, a double-acting press provided with an inner output of 900 tons and an outer output of 1,100 tons, totalling 2,000 tons must be provided, which is both extremely unreasonable as well as uneconomical.

SUMMARY OF THE INVENTION

To solve such problems, the present invention has aimed at the development of an hydraulic press in which the distribution ratio of the output of the inner and outer press rams has been made freely variable within the range of double acting press total output, through an extremely simple structure and operation. As to the structure of the present invention, a detailed explanation will be given based upon the diagrams showing examples of actual performance.

DESCRIPTION OF THE PREFERRED EMBODIMENT

Figure 1:
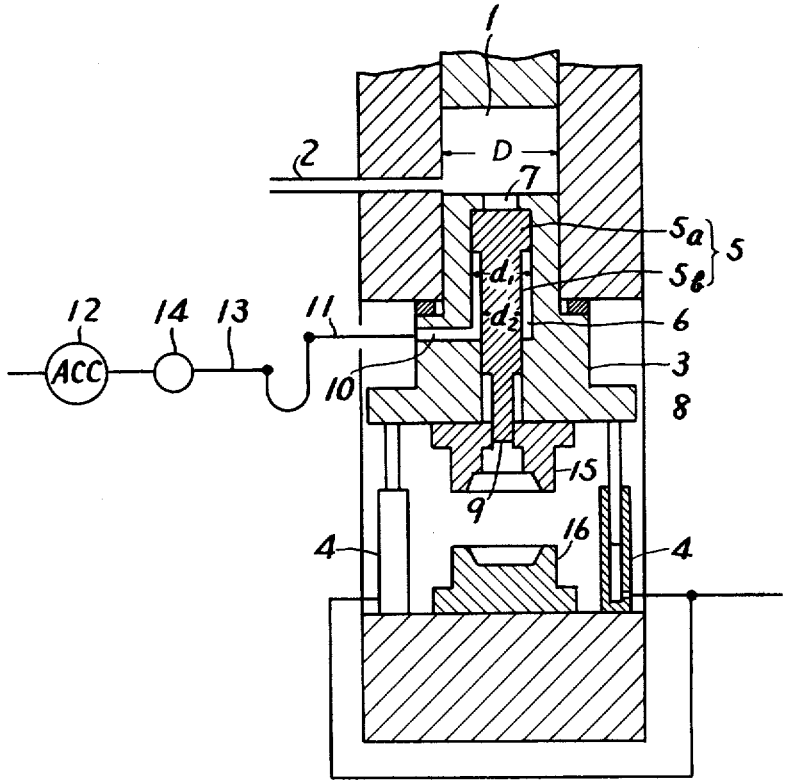
FIG. 1 shows a longitudinal sectional view of one embodiment according to the present invention.

In FIG. 1, cylinder 1 is supplied with working fluid through oil pipe 2. Outer press ram 3 drops due to the pressure of the working fluid, and rises again to its original level by the functioning of return cylinder 4.4. Inner press ram 5 is made up of piston 5*a* and rod 5*b*, and can move reciprocally inside small cylinder 6 which is mounted inside outer press ram 3.

Small cylinder 6 is connected with cylinder 1 via the restrictive opening 7 in the upper section 3', and therefore the pressure from the working fluid inside cylinder 1 simultaneously functions both on the upper surface of outer press ram 3 and that of piston 5*a* of the inner press ram. Rod 5*b* of inner press ram 5 penetrates oiltightly to the outside of outer press ram 3 through hole 8 which is drilled in the lower part, and through face 3'' of small cylinder 6, and its tip forms punch 9. The restricted end 3' forms a stop for piston 5*a*.

Oil channel 10 is installed on the side of rod 5*b* of small cylinder 6, and connects with flexible pipe 11. 12 is the accumulator, the control pressure oil source. Midway pipe 13 which connects accumulator 12 and flexible pipe 11, there is mounted oil pressure control valve 14. 15 is the upper mold while 16 is the lower mold.

In other words, the illustrated double-acting hydraulic press is a closed forging hydraulic press in which upper mold 15 and lower mold 16 are closed by outer press ram 3, while punch 9 is pushed into the mold by inner press ram 5. In the hydraulic press of the above composition, the sectional area of cylinder 1, i.e. $\frac{1}{4}\pi D^2$ is represented by A, the cross section of piston 5*a*, i.e. $\frac{1}{4}\#d_1^2$ by $B_1$, and the cross sectional area of rod 5*b*, i.e. $\frac{1}{4}\pi d_2^2$ by $B_2$.

Where the pressure generated in cylinder 1 from the working fluid is P, and the hydraulic pressure of the controlling press on the side of rod 5*b* in small cylinder 6 is 0:

The downward force of outer press ram 3 $= P \times (A - B_1)$

The downward force of inner press ram 5 $= P \times B_1$

Then, taking as P the hydraulic fluid pressure generated in cylinder 1, when control oil pressure the side of rod 5*b* in small cylinder 6 is 0, it is evident that:

Downward pressure of outer press ram 3

$$= P \times (A - B_1) + p(B_1 - B_2) \quad (1)$$

Downward pressure of inner press ram 5

$$= P \times B_1 - p(B_1 - B_2) \quad (2)$$

It is possible, in other words, to increase the outer output by adding the desired output and to decrease the inner output by reducing it by the desired amount, by selecting the suitable pressure p of the control oil which is fed into small cylinder 6 from oil channel 10.

It is unnecessary to add up the totals of formulae (1) and (2) to show that no change is seen in the total output after the above process. The fundamental principle of the present invention lies in this respect.

Figure 2:
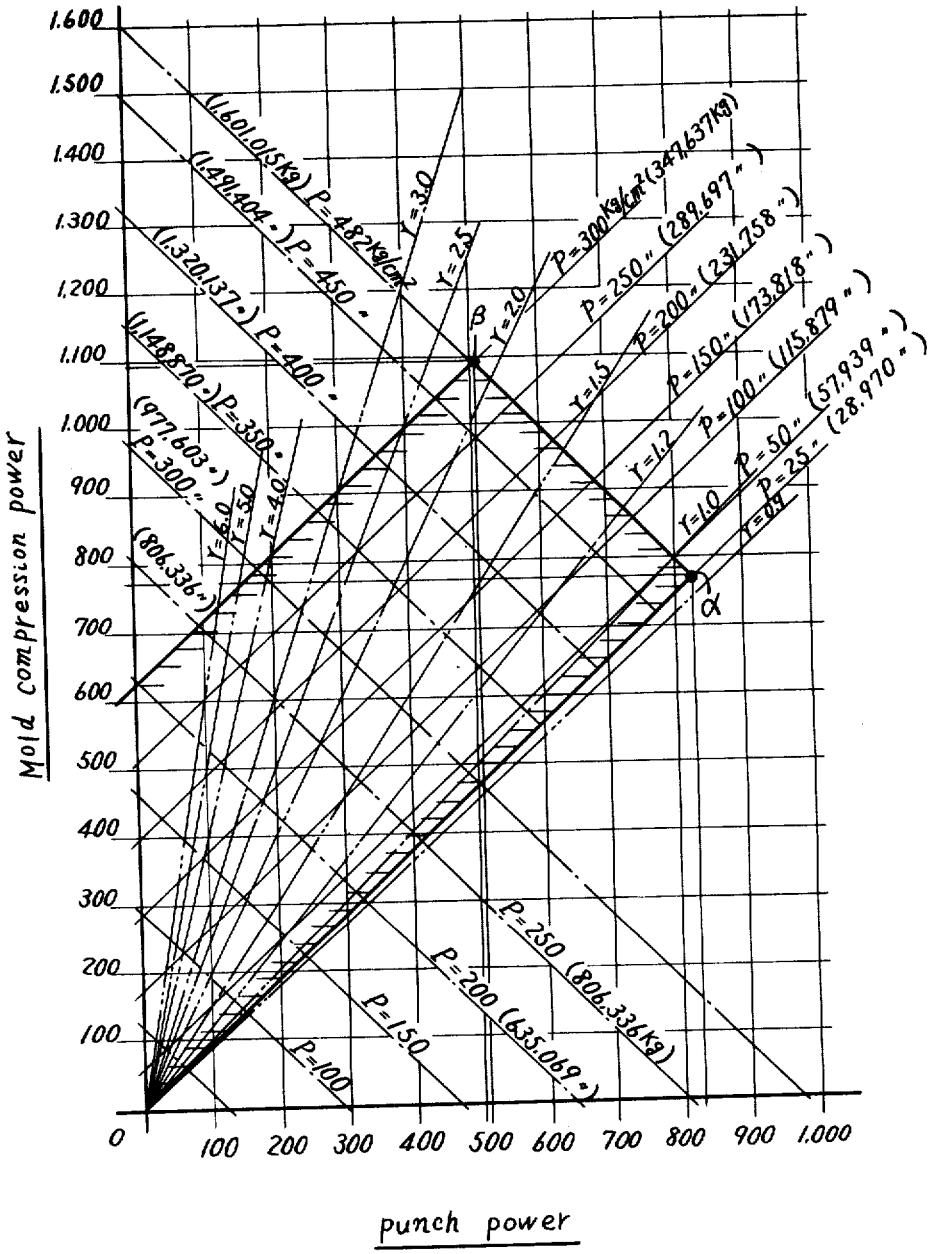
FIG. 2 shows characteristic of said one embodiment thereof.

FIG. 2 shows graphically the above-mentioned relation in a specific double-acting hydraulic press which was subject to the present invention. The diagram deals with a press which is provided with a total maximum output of 1,600 tons. The punch pushing power as the inner output and the mold compression power as the outer output are shown by taking them as the ordinate and abscissa respectively. The portion in shadow in the drawing represents the scope of application which is restricted by the fact that the practical scope for use of the control oil pressure in the present hydraulic press is $p=300 \sim 25$ kg/cm$^2$.

Also, the radial two-point linear line shows that the ratio between the mold compression power and the punch pushing force is a constant line. By way of illustration $r=20$ shows the above ratio is 20.

In the diagram, when $p=25$ kg/cm$^2$, the punch pushing force is about 830 tons and the mold compression power is about 770 tons at point a where the maximum total output can be utilized, and when $p=300$ kg/cm$^2$, the punch pushing force is about 510 tons and mold compression power is about 1,090 tons at point b where the maximum total output is utilized.

By controlling properly, as above, the control pressure oil through pressure control valve 14, it is possible to control distribution of the inner output and outer output freely in accordance with the distribution of output required by each product.

As the double acting hydraulic press in the present invention is composed as described above, being both simply constructed and easy to operate, it is possible to change the output distribution both of the inner and of the outer press rams, resulting in a wide expansion in the scope of workpieces which can be subject to processing by this single press.

The effects of this characteristic, which is not to be seen in conventional presses, are displayed to the full by the present press.

What is claimed is:

1. An hydraulically actuated press comprising:

a support frame including a first cylinder therein;

ram means having one end portion disposed within said cylinder and comprising a first piston;

a bore structure extending axially completely through said ram means, said bore structure being of restricted diameter at each end to thereby define an intermediate larger diameter bore section comprising a second cylinder;

a second piston, the second piston being disposed in said second cylinder and having one end operatively associated with the structure forming one of said restricted diameter bore ends, through which said second piston is exposed to the first cylinder and which said one restricted bore end functions as a stop means for said second piston;

said second piston being of reduced diameter excepting for said one end and the reduced diameter portion being reciprocally disposed in fluid-tight relationship in the second of said restricted diameter bore ends;

a tool element extending from a free end of the reduced diameter portion of the second piston and having a path of motion extending from within the ram means to through a face of the second end of the ram means;

said face comprising a tool means operatively associated with said tool element;

means to feed pressurized hydraulic fluid to said first cylinder, whereby to exert motive force to said first piston and, through said one restricted diameter bore end, to impart motive force to said second piston;

means to controllably pressurize and feed hydraulic fluid to the second cylinder at a location coinciding with the reduced diameter section of the second piston whereby the motive forces to said tool element may be variably apportioned;

means on said frame to support material to be operated on by each of said tool means and tool element; and means, separate and distinct from the afore recited hydraulic feed means to return said ram and second piston to an initial disposition following a working stroke.

2. The apparatus of claim 1 wherein the tool means is a mold member.

3. The apparatus of claim 1 wherein the means to support said material comprises a second mold member in operative association with the first recited mold member.

* * * * *